US009127382B2

(12) United States Patent
Ashworth et al.

(10) Patent No.: US 9,127,382 B2
(45) Date of Patent: Sep. 8, 2015

(54) PERSPIRATION CONTROL GLOVE

(75) Inventors: Jamie Ashworth, Freehold, NJ (US); Eric Michael Thompson, Central, SC (US); James H. Moreland, Central, SC (US); Jeffrey Charles Moreland, Simpsonville, SC (US)

(73) Assignee: Ansell Limited, Victoria (AU)

( * ) Notice: Subject to any disclaimer, the term of this patent is extended or adjusted under 35 U.S.C. 154(b) by 645 days.

(21) Appl. No.: 13/538,368

(22) Filed: Jun. 29, 2012

(65) Prior Publication Data

US 2013/0000360 A1 Jan. 3, 2013

Related U.S. Application Data

(60) Provisional application No. 61/571,569, filed on Jun. 30, 2011.

(51) Int. Cl.
*D04B 1/28* (2006.01)

(52) U.S. Cl.
CPC ..... *D04B 1/28* (2013.01)

(58) Field of Classification Search
CPC ..... A41D 19/015; A41D 19/01576; A41D 19/0055; A41D 19/0065
USPC ..... 2/161.3, 161.6, 161.7, 161.8, 167, 168
See application file for complete search history.

(56) References Cited

U.S. PATENT DOCUMENTS

| | | | | |
|---|---|---|---|---|
| 2,304,137 | A * | 12/1942 | Peakes | 2/168 |
| 4,733,413 | A * | 3/1988 | Dykstra | 2/169 |
| 5,036,551 | A * | 8/1991 | Dailey et al. | 2/167 |
| 5,070,540 | A * | 12/1991 | Bettcher et al. | 2/2.5 |
| 5,636,382 | A * | 6/1997 | Chopko et al. | 2/167 |
| 5,655,226 | A * | 8/1997 | Williams | 2/239 |
| 5,832,539 | A * | 11/1998 | Williams | 2/239 |
| 6,772,444 | B2 * | 8/2004 | Tremblay-Lutter | 2/164 |
| 6,962,064 | B1 | 11/2005 | Hardee et al. | |
| 7,037,579 | B2 | 5/2006 | Hassan et al. | |
| 7,803,438 | B2 | 9/2010 | Flather et al. | |
| 7,895,768 | B2 * | 3/2011 | Vossoughi et al. | 34/60 |
| 2004/0058102 | A1 * | 3/2004 | Baychar | 428/34.1 |
| 2004/0118387 | A1 | 6/2004 | Lawrence | |
| 2005/0136236 | A1 | 6/2005 | Hassan et al. | |
| 2007/0240247 | A1 * | 10/2007 | Beck | 2/16 |
| 2007/0294920 | A1 * | 12/2007 | Baychar | 36/113 |
| 2009/0211305 | A1 | 8/2009 | Thompson et al. | |

(Continued)

FOREIGN PATENT DOCUMENTS

| | | | |
|---|---|---|---|
| CN | 2473936 | Y | 1/2002 |
| CN | 1454232 | A | 11/2003 |
| EP | 0936883 | A1 | 8/1999 |
| RU | 2339655 | C2 | 11/2008 |

(Continued)

OTHER PUBLICATIONS

International Search Report and Written Opinion mailed Oct. 11, 2012 for PCT Application No. PCT/US2012/045022.

(Continued)

*Primary Examiner* — Danny Worrell
(74) *Attorney, Agent, or Firm* — Moser Taboada

(57) ABSTRACT

A perspiration control glove including a liner comprising knitted yarn, where the yarn comprises a wicking fiber, a shell comprising a polymeric material, the shell adhered to the liner, and an absorbent material element, where the element is coupled to the wicking fiber, and disposed between the liner and shell, to absorb and channel perspiration.

15 Claims, 3 Drawing Sheets

(56) References Cited

U.S. PATENT DOCUMENTS

| | | | | |
|---|---|---|---|---|
| 2010/0269241 | A1* | 10/2010 | Baychar | 2/69 |
| 2010/0275341 | A1 | 11/2010 | Sweeney et al. | |
| 2010/0292623 | A1 | 11/2010 | Greiner et al. | |
| 2012/0288662 | A1* | 11/2012 | Conolly | 428/87 |
| 2013/0247281 | A1* | 9/2013 | Zebouni | 2/272 |

FOREIGN PATENT DOCUMENTS

| | | | |
|---|---|---|---|
| WO | WO-9819569 | A1 | 5/1998 |

OTHER PUBLICATIONS

Chinese Office action, Application No. 201280031680.2, Dated Dec. 23, 2014.

* cited by examiner

PERSPIRATION CONTROL GLOVE

CROSS-REFERENCE TO RELATED APPLICATIONS

This application claims priority under 35 U.S.C. 119(e) to U.S. Provisional Application Ser. No. 61/571,569 filed Jun. 30, 2011, which is hereby incorporated by reference in its entirety.

BACKGROUND

1. Field of the Invention

Embodiments of the present invention generally relate to gloves and the fabrication of gloves and, more particularly, to a moisture control glove comprising perspiration control elements.

2. Description of the Related Art

Gloves are used in many industries and households to protect the hands of users. Many of such gloves, typically made of synthetic or natural latex, have substantially impervious properties. Gloves having impervious properties trap moisture and, in particular, trap perspiration inside the gloves. Gloves that trap perspiration inside feel clammy and uncomfortable to the user. This occurs particularly at the palm and finger areas and other areas where the glove most tightly contacts a user's skin. In addition, trapped perspiration within a glove promotes a moist, un-hygienic condition. Therefore, there is a need in the art for a glove that manages and controls perspiration within a glove.

SUMMARY

A perspiration control glove, and method for manufacturing a perspiration control glove, substantially as shown in and/or described in connection with at least one of the figures disclosed herein, are disclosed as set forth more completely in the claims. Various advantages, aspects, and features of the present disclosure, as well as details of an illustrated embodiment thereof, will be more fully understood from the following description and drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments. It is to be understood that elements and features of one embodiment may be in other embodiments without further recitation. It is further understood that, where possible, identical reference numerals have been used to indicate comparable elements that are common to the figures.

DETAILED DESCRIPTION

Embodiments of the present invention comprise a liner that can be knitted or woven into a glove, a shell that is made of, for example, synthetic or natural latex or mixtures thereof, and an absorbent material disposed between the liner and shell. A liner may be knitted by any conventional knitting process and may further comprise various deniers of yarns, which can be used to increase the channeling efficiency and distribution of moisture from one area of the liner to other areas and to the absorbent material element.

Figure 1:
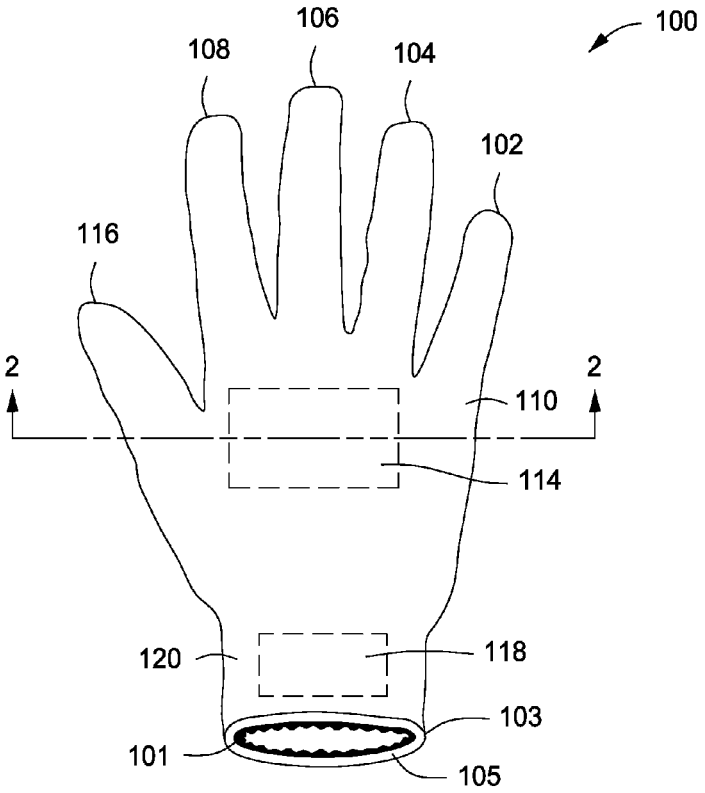
FIG. 1 is a perspective view of a right glove according to at least one embodiment of the invention.

FIG. 1 is a perspective view of a right glove according to at least one embodiment of the invention. Perspiration control glove 100 comprises liner 101, shell 103, finger areas 102, 104, 106, 108, and 116, backhand area 110, and a cuff area 120. Also included is at least one absorbent material element (two elements 114, 118 are shown in hidden lines in FIG. 1).

Shell 103 comprises a cured, polymeric coating further comprising natural or synthetic rubber latex or mixtures thereof, and may be impervious to liquids. The shell 103 is produced using known techniques, such as dip coating a glove shaped former into a liquid latex emulsion. The synthetic rubber latex may be selected from the group comprising polychloroprene, polyurethane, styrene-butadiene, nitrile-butadiene, carboxylated acrylonitrile butadiene, or any suitable polymeric or polymer latex coating, combinations thereof, and the like. Also, other additives, pigments, foaming agents, surfactants, processing aids, thixotropic agents, and fillers known to those of ordinary skill in the art may be incorporated within the liquid latex.

Liner 101 may be knitted or woven from a yarn into the form of a glove. In some embodiments, liner 101 comprises a yarn that is made from a wicking fiber, such as nylon or other hydrophilic materials. In some embodiments of the invention, liner 101 is knitted from nylon 6,6. One such nylon 6,6 is NILIT® AQUARIUS™, the highly-wicking features of which are described below.

The absorbent material element 114 or 118 is a water-scavenging absorbent reservoir. Absorbent material element 114 is attached to a surface of liner 101, for example, on or near back hand area 114 and cuff area 120. Absorbent material element 114 can be attached to liner 101 by stitching, a thermoplastic adhesive, glue, other suitable attaching means, and the like. The liner 101 is fluidly coupled to the absorbent material element 114, 118 to facilitate wicking of perspiration from one location of the glove to at least one absorbent material element.

After absorbent material element 114 is adhered to the liner 101, liner 101 is placed on a former. The liner having the absorbent material element attached is coated with a non-tacky adhesive 105 such as by hot-melt spraying, dry-powder spraying, or fiber-coating. Shell 103 is subsequently placed on the liner. This construction is then heated, cured, and allowed to cool, thereby creating an adhesive bond between shell 103 and liner 101, as described in commonly assigned U.S. Pat. No. 7,803,438, which is incorporated herein by reference in its entirety. Absorbent material element 114 is therefore disposed between shell 103 and liner 101. Also, in some embodiments of the invention, liner 101 is coated with adhesive 105 before element 114 is attached to liner 101.

Alternatively, some embodiments of the present invention include where shell 103 is formed on the front and portions of the back sides of liner 101 using the dipping process as described in commonly assigned US Patent Appl. Publ. No.

2009/0211305, filed on behalf of Thompson, et al., which is incorporated herein by reference in its entirety. In some embodiments of the invention, liner 101 is sprayed with a coating material.

Figure 2:
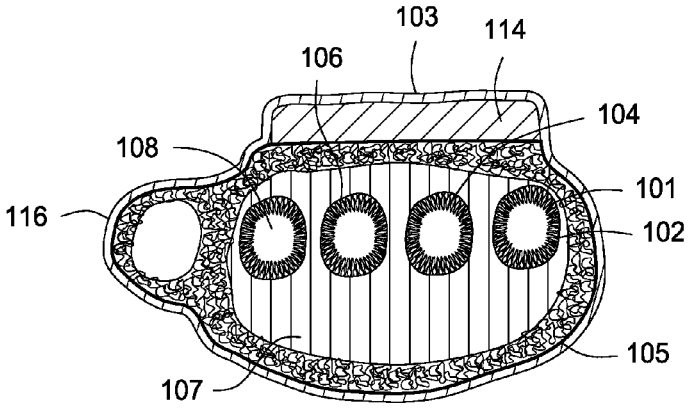
FIG. 2 depicts a cross-sectional view taken along the line 2-2 of the glove shown in FIG. 1.

FIG. 2 depicts a cross-sectional view of the glove along line 2-2 in FIG. 1. Shell 103 is bonded to liner 101 by adhesive layer 105 with absorbent material element 114 disposed between liner 101 and shell 103. Liner 101 is shown as a knitted layer, the wales 107 of knitted liner 101 run along the longitudinal axis of the glove, depicting channels formed by the fibers of the yarn as will be discussed in greater detail below. In various embodiments, liner 101 may be knitted using a Knit Variable Stitch Design (KVSD) technology as disclosed in commonly assigned U.S. Pat. No. 6,962,064, and US Patent Appl. Publ. No. 2009/0211305, each of which is incorporated herein by reference in its entirety.

Figure 3:
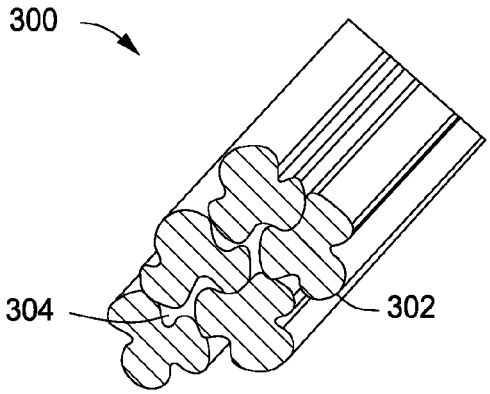
FIG. 3 is an enlarged perspective view of several fibers of the wicking yarn.

Regarding the yarn, FIG. 3 shows an enlarged perspective view of several strands of highly-wicking yarn 300, highlighting the irregular profile of the strand, which provides high-wicking characteristics compared with conventional yarns, such as cottons, cellulosics, and the like. The irregular cross-section of fibers 302, when part of yarn 300, form wicking channels 304, which have a much greater surface area for promoting the capillary effect. In other words, the volume of space between the fibers is increased relative to yarns having regularly shaped cross sections, which are circular. Therefore, a much faster and more efficient capillary action results, because the surface area between the fibers is where the wicking occurs. The greater surface area of the high-wicking yarn, relative to cottons, cellulosics, and the like, also results in the yarn taking longer to saturate, allowing the retention of greater amounts of moisture and dispersing moisture faster from perspiration-concentrated areas to other areas of the perspiration control glove. Therefore, the ability of the yarn to wick moisture from one area to another is greatly enhanced as compared with conventional yarns, producing a more comfortable, drier glove. Furthermore, yarns having larger deniers may now be used for the liner because previously, to attain wicking action, conventional materials, such as cotton, had to use smaller deniers because smaller deniers allow more fibers to be packed in a unit of area. In various embodiments of the invention, to enhance the directionality of the wicking, liner 101 may be knitted using a KVSD process as disclosed above. For example, some embodiments of the invention include areas reinforced with additional yarn in some sections of the glove, such as in areas of high perspiration, for example, the palm area.

Figure 4:
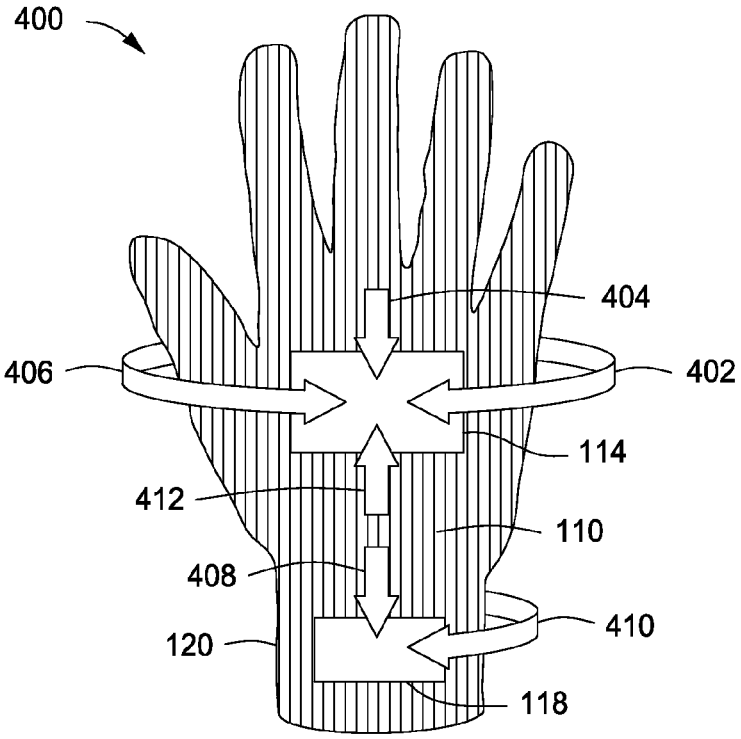
FIG. 4 depicts a backhand side view of a liner 400 of the glove, illustrating how perspiration wicks from one area to another area in the glove.

FIG. 4 depicts a backhand side view of a liner 400 of the glove, illustrating how perspiration wicks from one area to another area in the glove. Shell 103 is not shown in this view. Perspiration wicks, for example, most efficiently within the channels, depicted as extending parallel to the longitudinal axis of the glove, created by the irregularly shaped fibers from areas of liner 400 to other areas of liner 400 having absorbent material elements 114, 118.

As discussed above, the liner of the glove is comprised of a highly-wicking yarn that channels moisture, typically either or both of vapor and liquid perspiration. The highly-wicking yarn in the liner directionally channels moisture from one area of the hand, for example, the fingers or palm (where a user acutely notices wetness), to another area, such as the back of the hand or cuff (where a user is less likely to notice wetness). In some embodiments of the invention, as discussed below, the absorbent material element is located on the backhand area or cuff area. Directional channeling is most efficient where the channels of the fibers are parallel with the wales of the knitted liner at least because liners knitted in this fashion have more fibers oriented toward a particular direction and, therefore, more channels formed by the surfaces of the fibers are oriented in that direction. In FIG. 4, the wales of the knit run longitudinally, i.e., parallel to an axis from the finger area to the cuff area. Other knitting patterns allow for a multitude of directions. As discussed above, moisture is wicked via capillary action within the channels formed by the fibers of the yarn. In this manner, perspiration can wick in a straight channel, i.e., a "highway," to another area of the glove as opposed to spreading radially, which would be the typical manner in which moisture spreads in other fabrics, e.g., cotton, cellulosics, rayons, and the like. The highly-wicking yarn of the liner directs the moisture toward the cuff and back hand area having the absorbent material element, which draws moisture inward and therefore acts as a reservoir. By channeling the moisture away from the palm and fingers and to the center of the absorbent material element, a wet or clammy feeling is avoided, promoting hygiene and comfort.

As mentioned above, the absorbent material element 114 is made of a moisture-scavenging, "super-absorbent" material. In some embodiments of the invention, the super absorbent material comprises an electrospun polyurethane and bound acrylate. One super absorbent material suitable for use in embodiments of the invention is SNS NANOSORB™ 28. SNS NANOSORB™ 28 is known to hold 180 times its weight in water, and absorbs 30 times its weight of saline/ionized water. Additionally, the ability of SNS NANOSORB™ 28to absorb water exceeds by 15-20 times the absorption capability generally provided by cotton or cellulose materials.

Without intending to be bound by theory, another effect of the use of super absorbent SNS NANOSORB™ 28 is a push-pull effect. To illustrate, as mentioned above, moisture wicks within the channels 204 formed by the irregular cross sections of the fibers comprising highly wicking liner 101. An absorbent material element comprising SNS NANOSORB™ 28, having excellent water retention, then pulls in moisture at a faster rate than highly wicking liner 101 wicks to it. This quality further slows the saturation of the fibers comprising highly wicking liner 101, resulting in highly wicking liner 101 remaining relatively dry. Furthermore, absorbent material element 114 pulls the moisture from highly wicking liner 101 into its internal matrix, in effect acting as a reservoir. This leaves the surface of the absorbent material element 114, which is in fluid contact with highly wicking liner 101, continuously scavenging for moisture from the highly wicking liner 101, thus further promoting the capillary action of highly wicking liner 101. In other words, because absorbent material element has a higher affinity for moisture than highly wicking liner 101, highly wicking liner 101 is induced to wick moisture even quicker to absorbent material element 114 as compared to the wicking action where no absorbent material element 114 is present. Such moisture movement thereby leaves highly wicking liner 101 substantially dry and keeps the moisture and perspiration away from a user's skin. Embodiments of the invention comprise patches of absorbent material element 114 in one or more areas and in many shapes and sizes as will be disclosed below.

As shown in FIG. 4, perspiration is wicked from four directions 402, 404, 406, 412 to absorbent material element 114 at backhand area 110. As mentioned above, perspiration will be most effectively directionally wicked within the wicking channels. Directions 402 and 406 show perspiration being wicked from palm area 302 (not shown). In this view, perspiration is also wicked from the finger areas to the backhand area 110 as depicted by direction 404. Also shown is perspiration being wicked from palm area 302 to cuff area 120 by direction 410 and from backhand area 110 to absorbent material element 118 by direction 408 and to absorbent material element 114 via direction 412. In practice, perspiration may be wicked within channels from other different directions depending on the knit pattern. Additionally, liner 101 may comprise many known knitting patterns so that the channels of the yarn are oriented along different axes, thereby enhancing the directional wicking of moisture toward the absorbent material element.

Figure 5:
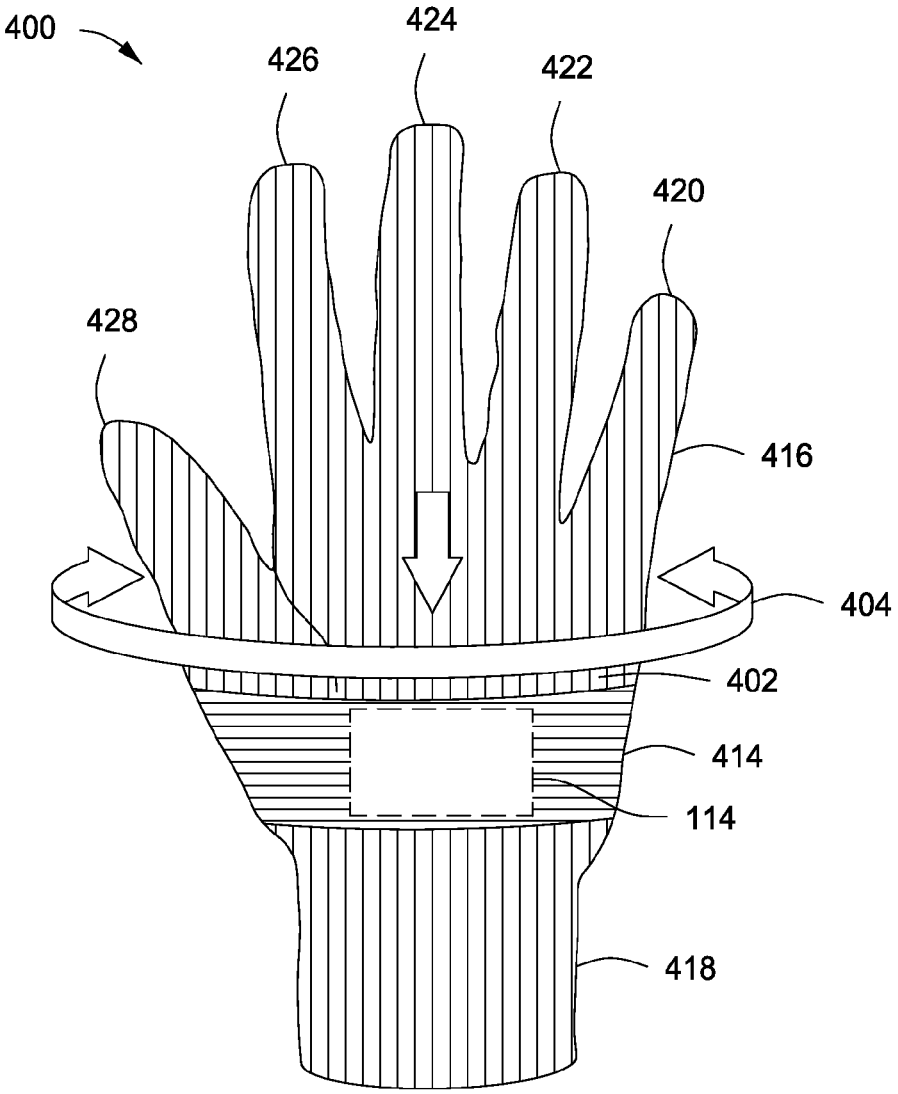
FIG. 5 depicts a palm area view of a liner according to at least one embodiment of the invention.

FIG. 5 shows the palm area of the liner 400 according to at least one embodiment of the invention. Perspiration is directionally wicked from palm area 402 of liner 400. Perspiration 404 is wicked laterally along palm area 402 to the absorbent material element 114 (shown in hidden lines) located on backhand area 110. In this embodiment, highly wicking liner 400 may be comprised of one or more knitting patterns. For example, a band 414 is comprised of a knit of yarn having wicking channels (shown by dark, horizontal lines) that run laterally from the palm area 402 to back hand area 110, as opposed to the longitudinally wicking channels in finger areas 420, 422, 424, 426, 428 and cuff area 418 (shown by dark, vertical lines).

Other embodiments may position absorbent material elements in various locations and have various shapes and thicknesses to promote comfort and or absorbency of a glove according to embodiments of the invention. The backhand area 110 and cuff area 120 are good choices for locations for the absorbent material element because these areas are typically subjected to little strain and do not contact the skin of the user as tightly as in other areas of a glove. In other words, moisture is taken away from the palm and finger areas, which have relatively high concentrations of perspiration and are high strain areas, where the glove most tightly contacts the skin of the user during use, and is channeled to areas where there is looser contact with skin, such as backhand area 110 and cuff area 120.

While the foregoing is directed to embodiments of the present invention, other and further embodiments of the invention may be devised without departing from the basic scope thereof, and the scope thereof is determined by the claims that follow.

The invention claimed is:

1. A perspiration control glove, comprising:

a highly wicking knitted liner comprising a knitted yarn having fibers of an irregular cross section that form channels for wicking perspiration;

an elastomeric shell comprising a polymeric material, the elastomeric shell adhered to the highly wicking knitted liner; and a super absorbent material element to absorb perspiration coupled to the channels, and disposed between the highly wicking knitted liner and the elastomeric shell, wherein the super absorbent material element is more absorbent than the yarn forming the channels such that perspiration is transported from remote regions of the highly wicking knitted liner to the super absorbent material element.

2. The glove of claim 1, wherein the yarn comprises nylon 6,6.

3. The glove of claim 1, wherein the absorbent material element comprises a patch.

4. The glove of claim 3, wherein the patch is coupled to the highly wicking liner by one of stitching, adhered with glue, epoxy, or thermoplastic adhesive.

5. The glove of claim 1, wherein the absorbent material element comprises an electrospun polyurethane & bound acrylate.

6. The glove of claim 1, wherein the highly wicking liner comprises one of many knitting patterns to channel directionally perspiration toward the absorbent material element.

7. The glove of claim 1, wherein the absorbent material element comprises two or more patches.

8. A method of making a perspiration control glove, comprising:

knitting a highly wicking liner in the shape of a glove, the highly wicking liner comprising a highly wicking yarn having fibers of an irregular cross section that form channels for wicking perspiration;

attaching at least one super absorbent material element to the highly wicking knitted liner;

adhering an elastomeric shell to the highly wicking liner, where the at least one super absorbent material element is disposed between the highly wicking liner and elastomeric shell to absorb perspiration wicked to the at least one element by the highly wicking knitted liner, wherein the super absorbent material element is more absorbent than the highly wicking knitted liner such that perspiration is transported from remote regions of the highly wicking knitted liner to the super absorbent material element.

9. The method of claim 8, wherein the highly wicking liner is knitted using a KVSD process.

10. The method of claim 8, wherein the attaching step comprises one of gluing, stitching, or applying and curing a thermoplastic adhesive or epoxy.

11. The method of claim 8, wherein the adhering step comprises one of applying a thermoplastic adhesive, glue, or epoxy onto the highly wicking liner, placing the elastomeric shell onto the highly wicking liner, and curing the thermoplastic adhesive, glue, or epoxy.

12. The glove of claim 1, wherein a push-pull effect pulls in moisture to the super absorbent material element at a faster rate than highly wicking knitted liner wicks to the super absorbent material element.

13. The glove of claim 1, further comprising a water-scavenging reservoir attached to a surface of the highly wicking knitted liner.

14. The method of claim 8, wherein a push-pull effect pulls in moisture to the super absorbent material element at a faster rate than highly wicking knitted liner wicks to the super absorbent material element.

15. The method of claim 8, further comprising a water-scavenging reservoir attached to a surface of the highly wicking knitted liner.

* * * * *